US010889402B2

(12) United States Patent
Florez-Bedoya et al.

(10) Patent No.: US 10,889,402 B2
(45) Date of Patent: Jan. 12, 2021

(54) REFILLABLE PET CONTAINER

(71) Applicant: AMCOR RIGID PACKAGING USA, LLC

(72) Inventors: Daniel Florez-Bedoya, Ypsilanti, MI (US); Michael Wurster, Chelsea, MI (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 147 days.

(21) Appl. No.: 15/770,958

(22) PCT Filed: Dec. 7, 2016

(86) PCT No.: PCT/US2016/065252
§ 371 (c)(1),
(2) Date: Apr. 25, 2018

(87) PCT Pub. No.: WO2017/100239
PCT Pub. Date: Jun. 15, 2017

(65) Prior Publication Data

US 2018/0312292 A1 Nov. 1, 2018

Related U.S. Application Data

(60) Provisional application No. 62/266,343, filed on Dec. 11, 2015.

(51) Int. Cl.
*B65D 1/02* (2006.01)
*B65D 79/00* (2006.01)

(52) U.S. Cl.
CPC ..... *B65D 1/0276* (2013.01); *B65D 79/005* (2013.01)

(58) Field of Classification Search
CPC ... B65D 1/0276; B65D 79/005; B65D 1/0261
USPC ..... 220/675, 609, 608; 215/376
See application file for complete search history.

(56) References Cited

U.S. PATENT DOCUMENTS

| | | | |
|---|---|---|---|
| 5,989,661 | A | 11/1999 | Krishnakumar et al. |
| 6,299,007 | B1 | 10/2001 | Takeuchi |
| 2009/0293436 | A1 | 12/2009 | Miyazaki et al. |
| 2013/0087954 | A1 | 4/2013 | Tsuchiya |

(Continued)

FOREIGN PATENT DOCUMENTS

EP 0817716 B1 6/2002

OTHER PUBLICATIONS

International Search Report issued in PCT/US2016/065252, dated Mar. 3, 2017, ISA/KR.

(Continued)

*Primary Examiner* — James N Smalley
*Assistant Examiner* — Madison L Poos
(74) *Attorney, Agent, or Firm* — Harness, Dickey & Pierce, P.L.C.

(57) ABSTRACT

A refillable container including a base having a standing surface surrounding a push-up portion. The push-up portion includes a central portion at a center of the base that is recessed inward from a plane extending across the standing surface. A longitudinal axis of the container extends from a first end of the container to a second end through the central portion. A linear portion of the base extends radially outward from the central portion towards the standing surface of the base. The base is configured to reduce stress crack failures.

26 Claims, 2 Drawing Sheets

(56) References Cited

U.S. PATENT DOCUMENTS

| | | | | |
|---|---|---|---|---|
| 2014/0061211 | A1* | 3/2014 | Patcheak ..... | B65D 1/0276 220/609 |
| 2014/0123603 | A1 | 5/2014 | Denner et al. | |
| 2014/0166676 | A1 | 6/2014 | Melrose | |

OTHER PUBLICATIONS

Written Opinion issued in PCT/US2016/065252, dated Mar. 3, 2017, ISA/KR.

* cited by examiner

REFILLABLE PET CONTAINER

CROSS-REFERENCE TO RELATED APPLICATIONS

This application is a 371 U.S. National Phase Application under 35 U.S.C. 371 of International Application No. PCT/US2016/065252, filed Dec. 7, 2016 and published in English as WO 2017/100239 A1 on Jun. 15, 2017, which claims the benefit of and priority to U.S. Ser. No. 62/266,343, filed Dec. 11, 2015. The entire disclosures of the above applications are incorporated herein by reference.

FIELD

The present disclosure relates to refillable containers, and specifically to bases thereof.

BACKGROUND

This section provides background information related to the present disclosure, which is not necessarily prior art.

As a result of environmental and other concerns, plastic containers, more specifically polyester and even more specifically polyethylene terephthalate (PET) containers, are being used more than ever to package numerous commodities previously supplied in glass containers. Manufacturers and fillers, as well as consumers, have recognized that PET containers are lightweight, inexpensive, recyclable, and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\% \text{ Crystallinity}=(\rho-\rho_a/\Sigma_c-\rho_a)\times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation.

PET containers are often reused and refilled numerous times with product, such as carbonated soda, and must therefore be physically robust in order to withstand multiple filling and distribution cycles. For example, the containers must be able to withstand various stresses, such as base stress cracks that may develop due to repeated cycles of filling, distribution, return, washing, and refilling. If stress cracks in the base are severe, they may lead to failures, such as breaking, bursting, and leaking.

A typical refillable PET container is stretch blow molded from a preform, which is formed by injection molding. The container is filled with product, such as carbonated soda for example, and then capped. The filled container is then distributed, sold, and used by customers. The container will often be returned for refilling. Returned containers are inspected for potential issues, such as scuffs, cracks, physical abuse, damaged threads, and stress cracks in the base. Returned containers are also tested for foreign contaminants, such as with any suitable sniffer test. The returned containers are processed with a caustic wash, and rinsed with water. The rinsed containers are immediately refilled with product and can again be sold and used by customers. This refilling process is repeated with a target of at least fifteen cycles before the containers become unusable and must be scrapped.

In order to test refillable PET containers for their ability to withstand the refilling process, accelerated tests have been developed. Accelerated testing has a higher target of successful cycles, such as twenty-five. One example of an accelerated test includes washing containers with a caustic solution, and rinsing the containers with water. The containers are then filled and capped with product, such as carbonated water. The filled containers can be heated to an elevated temperature for a specific period of time. This process is repeated about twenty-five times, as the containers are periodically observed for signs of stress cracking.

Another exemplary accelerated test includes washing the containers with a caustic solution, rinsing the containers with water, and then pressurizing the containers with 50-80 PSI of air for a few seconds. This process is repeated until 50% of the sample containers fail.

The present teachings provide for improved refillable PET containers that can be refilled numerous times without failure due to severe stress cracks, such as base stress cracks that cause breaking, bursting, or leaking. For example, the refillable PET containers according to the present teachings can withstand about thirty-two accelerated test cycles without the occurrence of base stress crack failure, which is about a 30% improvement over industry standard requirements.

SUMMARY

This section provides a general summary of the disclosure, and is not a comprehensive disclosure of its full scope or all of its features.

The present teachings provide for a refillable container including a base having a standing surface surrounding a push-up portion. The push-up portion includes a central portion at a center of the base that is recessed inward from a plane extending across the standing surface. A longitudinal axis of the container extends from a first end of the container to a second end through the central portion. A linear portion of the base extends radially outward from the central portion towards the standing surface of the base. The linear portion and the central portion are movable towards the first end of the container in response to an internal volume within the container, and away from the first end of the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
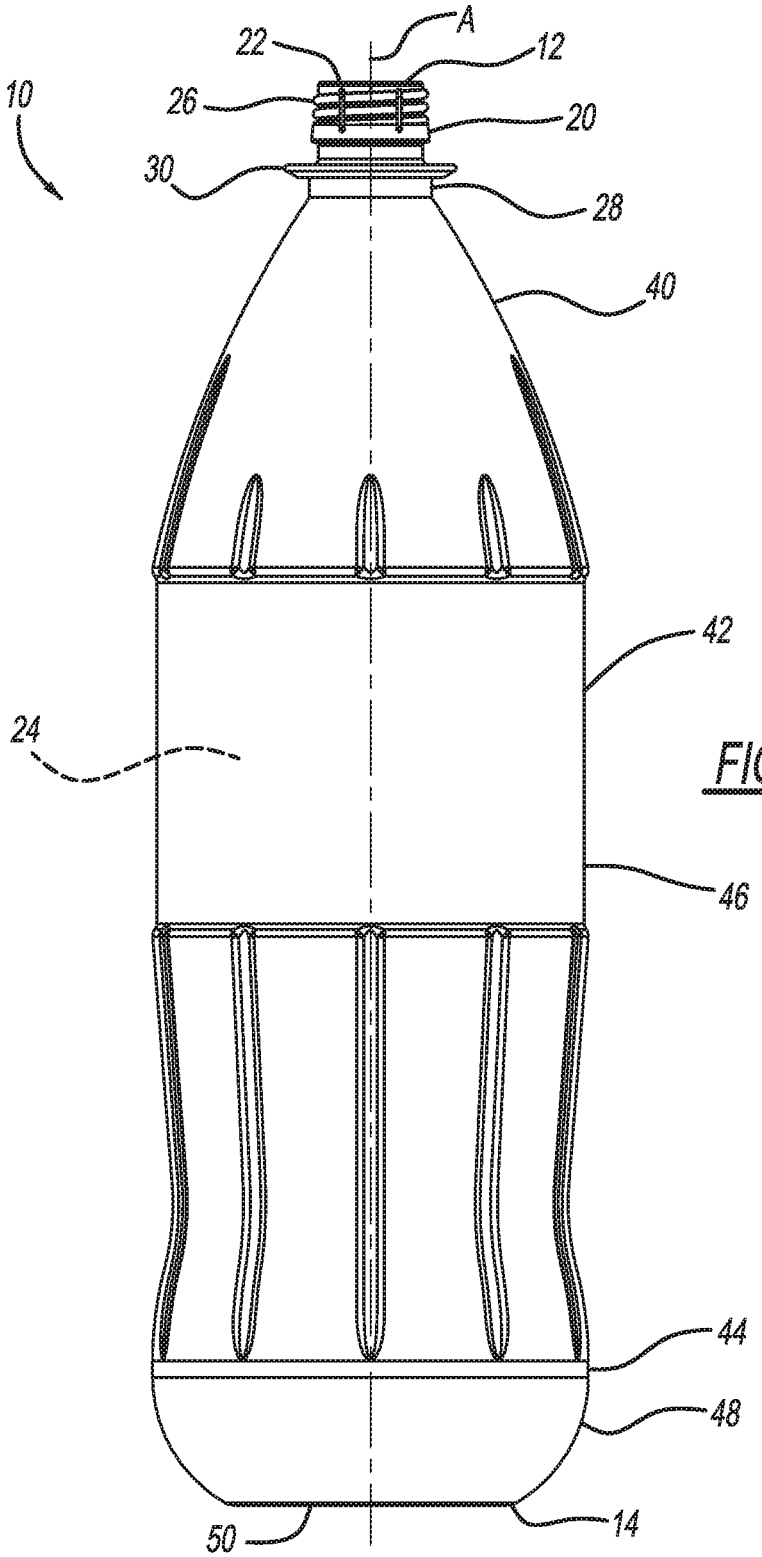
FIG. 1 is a side view of a refillable container according to the present teachings.

With initial reference to FIG. 1, a refillable container according to the present teachings is illustrated at reference numeral 10. The container 10 can be made of any suitable material, such as PET, LDPE, HDPE, PP, PS, and the like. The refillable container 10 generally includes a first end 12 and a second end 14, which is opposite to the first end 12. A longitudinal axis A of the container 10 extends from the first end 12 to the second end 14.

At the first end 12 is a finish 20, which defines an opening 22 of the container 10. The container 10, and specifically an internal volume 24 thereof, can be filled with product inserted through the opening 22. Product can also be withdrawn from the internal volume 24 through the opening 22. The container 10 can be configured to hold any suitable product therein, such as carbonated water, soda, and the like. The opening 22 can be closed with any suitable closure, such as a closure including threads configured to cooperate with threads 26 of the finish 20.

The refillable container 10 further includes a neck 28, which extends away from the finish 20. Between the neck 28 and the finish 20 is a flange 30. Extending from the neck 28 away from the finish 20 and the flange 30 is a shoulder 40. The shoulder 40 extends along the longitudinal axis A to a body portion 42 of the container 10. The shoulder 40 tapers outward away from the longitudinal axis A as the shoulder 40 extends away from the neck 28 to the body 42. The body 42 extends towards the second end 14 to a bumper 44 of the container 10. A sidewall 46 of the container 10 generally defines the shoulder 40 and the body 42, as well as the internal volume 24. A heel 48 of the container 10 extends from the bumper 44 to a base 50 of the container 10.

Figure 2:
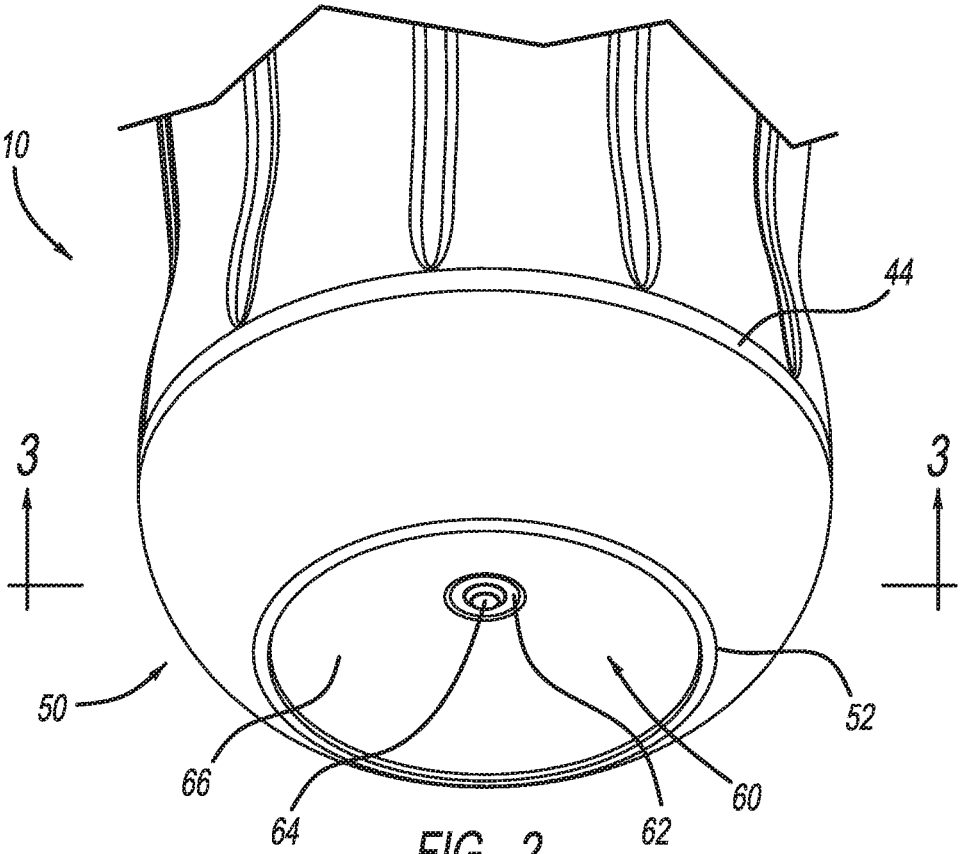
FIG. 2 is a perspective view of a base portion of the container of FIG. 1.
Figure 3:
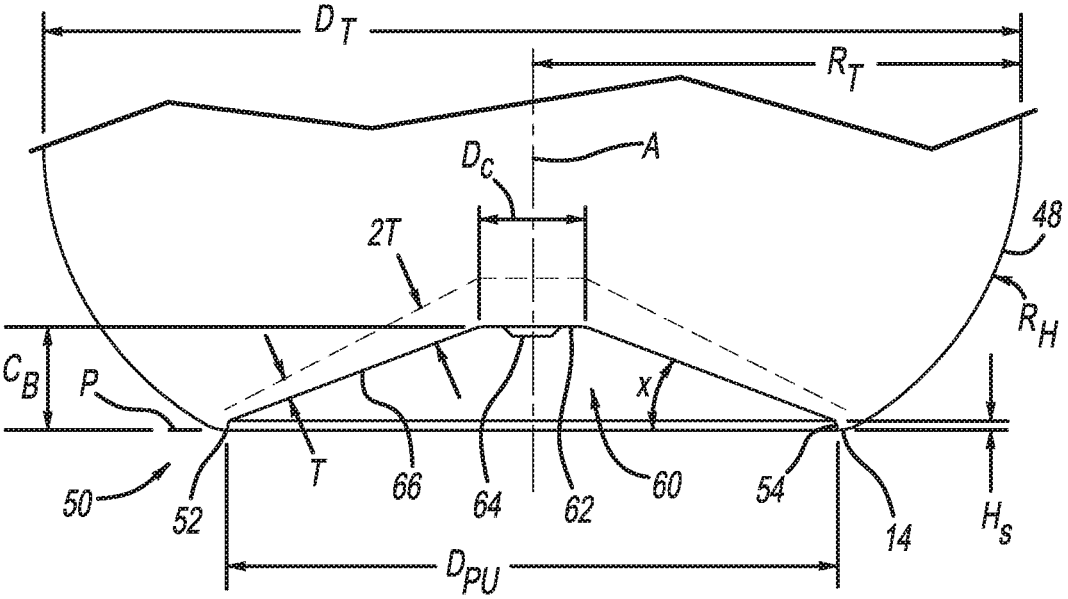
FIG. 3 is a cross-sectional view taken along line 3-3 of FIG. 2.

With continued reference to FIG. 1 and additional reference to FIGS. 2 and 3, the base 50 will now be described in detail. The base 50 generally includes a standing ring 52 and a push-up portion 60. The standing ring 52 generally surrounds the push-up portion 60, and is configured such that when the container 10 is seated on a flat surface, the standing ring 52 will support the container 10 upright. The standing ring 52 is generally circular, but may have any other suitable shape, such as an oval shape. The heel 48 tapers inward towards the longitudinal axis A from the bumper 44 to the standing ring 52 at any suitable curve radius $R_H$. For example, the curve radius $R_H$ can be 34.53 mm, or about 34.53 mm. The container 10 includes a total radius $R_T$, which is illustrated in FIG. 3. The total container radius $R_T$ can be 1.5 times greater than, or about 1.5 times greater than, the radius $R_H$ of the heel 48.

The push-up portion 60 includes a central portion 62 at an axial center of the push-up portion 60. The longitudinal axis A of the container 10 extends through the central portion 62. The central portion 62 has a diameter $D_C$ of any suitable size, such as 11.41 mm or about 11.41 mm. At a center of the central portion 62 is a gate 64, which protrudes outward from the central portion 62. The central portion 62 and gate 64 are recessed within the base 50. Specifically, the central portion 62 and gate 64 thereof are spaced apart from a plane P (FIG. 3) that extends across the standing ring 52. The plane P may also represent a standing surface that the container 10 is seated on. The central portion 62 is recessed inward to provide a base clearance $C_B$ of any suitable distance, such as 10 mm or about 10 mm.

Extending outward from the central portion 62 is a linear portion 66 of the push-up portion 60. The linear portion 66 linearly extends towards the standing ring 52 and the second end 14. The linear portion 66 slopes downward towards the second end 14 at any suitable angle, such as push-up angle X. The push-up angle X can be any suitable angle, such as 20.41°, or about 20°. The linear portion 66 is connected to the standing ring 52 with a stepped portion 54, which may be angled towards the longitudinal axis A as the stepped portion 54 extends from the standing ring 52 to the linear portion 66. The stepped portion 54 can have any suitable length to provide any suitable step height $H_S$. For example, the step height $H_S$ can be 1 mm or about 1 mm. The linear portion 66 and the central portion 62 are movable away from the first end 12 of the container 10 in response to an internal pressure within the container 10, and towards the first end of the container 10 after pressure within the container 10 decreases. The linear portion 66 and the central portion 62 will hinge at the second end 14, standing ring 52, and stepped portion 54.

The linear portion 66 gradually and uniformly decreases in thickness as it extends from the central portion 62 towards the standing ring 52. The linear portion 66 is thus most thick proximate to the central portion 62, and is thinnest proximate to the standing ring 52 and the stepped portion 54. For example, the linear portion 66 can have a thickness 2T proximate to the central portion 62 that is twice as thick as a thickness T proximate to the standing ring 52 and the stepped portion 54.

An overall diameter of the container 10 is designated by $D_T$ of FIG. 3, and can be any suitable size. For example, the diameter $D_T$ can be 104 mm, or about 104 mm. The push-up portion 60 has a diameter $D_{PU}$, which can be any suitable size. For example, the diameter $D_{PU}$ can be 65 mm, or about 65 mm. The diameter $D_{PU}$ of the push-up portion 60 can be 5.7 times greater than the diameter $D_C$ of the central portion 62, or about 5.7 times greater. The total diameter $D_T$ of the container 10 can be 1.6 times greater than the diameter $D_{PU}$ of the push-up portion 60, or about 1.6 times greater.

The base 50 can have an overall surface area that is 4 times greater than a total surface area of the push-up portion 60, or about 4 times greater. The overall surface area of the base 50 includes the surface area of the heel 48 and the push-up portion 60, which includes the central portion 62, the gate 64, the linear portion 66, and the stepped portion 54. The total surface area of the base 50 can be 147.209 $cm^2$, or about 147.209 $cm^2$. The total surface area of the push-up portion 60 can be 35.585 $cm^2$, or about 35.585 $cm^2$. The projected surface area of the push-up portion 60 can be about 33.183 $cm^2$ or about 33.183 $cm^2$. The ratio of total surface area of the push-up portion 60 to projected surface area of the push-up portion 60 can be 1.07, or about 1.07. It is advantageous to have a ratio of total surface area of the push-up portion 60 to projected surface area of the push-up portion 60 of less than 1.2. The total surface area of the push-up portion 60 is about 15% smaller than existing containers, which may have a surface area of about 41 $cm^2$. The smaller total surface area of the push-up portion 60 advantageously allows the container 10 to be refilled (i.e., recycled) a greater number of times without experiencing stress crack failures, such as stress cracks in the base 50 causing breaking, bursting, or leaking.

The flat, conical shape of the push-up portion 60 is in contrast to existing refillable containers, which have a more domed or rounded shape. The flat, conical shape of the push-up portion 60 of the base 50 advantageously allows for a greater thickness of the linear portion 66 without increasing the overall weight of the base 50. The gradual and uniform transition of the linear portion 66 from the relatively thick portion at 2T to the relatively thin portion T advantageously reduces material stresses caused by blow molding, and stresses caused by movement of the base 50 due to internal pressure changes, which may lead to stress cracking. The clearance $C_B$ is generally less than existing refillable containers, which further contributes to a reduction of surface area at the push-up portion 60.

The present teachings provide for improved refillable PET containers that can be refilled numerous times without the occurrence of stress crack failures, such as base stress cracks that are severe enough to cause breaking, bursting, or leaking. For example, the refillable PET containers according to the present teachings can withstand about thirty-two accelerated test cycles without the occurrence of base stress crack failures, which is a 30% improvement over industry standard requirements. This is due to the configuration of the base 50 described above, such as the following features: the reduced surface area of the push-up portion 60 as compared to existing containers; the linear nature of the linear portion 66; the push-up angle X being more shallow as compared to existing containers; the gradual and uniform decrease in thickness of the linear portion 66 as the linear portion 66 extends from the central portion 62 towards the standing ring 52, and the presence of the stepped portion 54.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A refillable container comprising:

a finish defining an opening to an internal volume of the container, the finish at a first end of the container;

a base at a second end of the container that is opposite to the first end;

a standing surface included with the base at the second end; and a push-up portion of the base surrounded by the standing surface, the push-up portion including:

a central portion at a center of the base and recessed inward from a plane extending across the standing surface, a longitudinal axis of the container extends from the first end to the second end through the central portion; and a substantially linear portion extending radially outward from the central portion to a standing ring of the base;

wherein the substantially linear portion and the central portion are movable away from the first end of the container in response to an increase of internal pressure within the container and towards the first end of the container when the pressure decreases, the substantially linear portion remains substantially linear as the substantially linear portion moves towards the first end of the container;

wherein the substantially linear portion gradually and uniformly decreases in thickness as the substantially linear portion extends outward from the central portion to the standing ring; and wherein the substantially linear portion is at a first acute angle relative to a plane extending across the standing surface and moves to a second acute angle relative to the plane after the substantially linear portion moves away from the first end of the container in response to the increase of internal pressure within the container.

2. The refillable container of claim 1, wherein the standing surface is a ring surrounding the push-up portion.

3. The refillable container of claim 1, wherein the substantially linear portion extends radially outward from the central portion at an angle of about 20° relative to the plane extending across the standing surface.

4. The refillable container of claim 1, wherein the substantially linear portion is thickest at the central portion.

5. The refillable container of claim 1, wherein proximate to the central portion the substantially linear portion is about twice as thick as proximate to the standing surface.

6. The refillable container of claim 1, further comprising a stepped portion of the base extending between the standing surface and the substantially linear portion.

7. The refillable container of claim 6, wherein the stepped portion extends about 1 mm from the standing surface to the substantially linear portion.

8. The refillable container of claim 1, wherein the push-up portion has a maximum push-up diameter that is 5.7 times greater than a maximum center diameter of the central portion.

9. The refillable container of claim 8, wherein:

the push-up portion has a maximum push-up diameter of about 65 mm; and the central portion has a maximum central diameter of about 11.41 mm.

10. The refillable container of claim 1, wherein the container has a maximum total diameter that is 1.6 times greater than a maximum push-up diameter of the push-up portion.

11. The refillable container of claim 1, further comprising a heel extending from the standing surface to a sidewall of the container;

wherein the container has a total container radius of curvature that is about 1.5 times greater than a heel radius of curvature of the heel.

12. The refillable container of claim 11, wherein:

the heel radius of curvature is about 34.5 mm; and the total container radius of curvature is about 51.75 mm.

13. The refillable container of claim 1, wherein the central portion is recessed about 10 mm inward from the plane extending across the standing surface.

14. The refillable container of claim 1, further comprising a bumper between the base and a body of the container.

15. The refillable container of claim 14, wherein the push-up portion of the base has a push-up portion total surface area that is four times less than a total surface area of the base below the bumper.

16. The refillable container of claim 15, wherein the push-up portion total surface area is about 35.6 $cm^2$, and the total surface area of the base below the bumper is about 147.2 $cm^2$.

17. The refillable container of claim 1, wherein the push-up portion is generally cone-shaped.

18. The refillable container of claim 1, further comprising a gate at a center of the central portion.

19. The refillable container of claim 1, wherein the container is configured to be filled, emptied, and refilled at least 15 times without stress cracking failure occurring at the base.

20. The refillable container of claim 1, wherein the container is configured to be filled, emptied, and refilled at least 25 times without stress cracking failure occurring at the base.

21. The refillable container of claim 1, wherein the container is configured to be filled, emptied, and refilled at least 32 times without stress cracking occurring at the base.

22. The refillable container of claim 1, wherein the container is configured to withstand an accelerated test run at least 25 times without stress cracking failure at the base, the accelerated test including the following:

washing the container with a caustic solution;

rinsing the container with water;

filling and capping the container with a product; and heating the filled container to an elevated temperature for a predetermined period of time.

23. The refillable container of claim 22, wherein the product is carbonated.

24. The refillable container of claim 1, wherein the container is configured to withstand an accelerated test run at least 25 times without stress cracking at the base, the accelerated test including the following:

washing the container with a caustic solution;

rinsing the container with water; and pressurizing the container for a predetermined period of time.

25. The refillable container of claim 1, wherein a ratio of a total surface area of the push-up portion to a projected surface area of the push-up portion is less than 1.2.

26. The refillable container of claim 1, wherein a ratio of a total surface area of the push-up portion to a projected surface area of the push-up portion is about 1.07.

* * * * *